US007431023B2

(12) United States Patent
Kavanagh et al.

(10) Patent No.: US 7,431,023 B2
(45) Date of Patent: Oct. 7, 2008

(54) ENGINE PCV SYSTEM WITH VENTURI NOZZLE FOR FLOW REGULATION

(75) Inventors: Scott A. Kavanagh, Shelby Township, MI (US); David K. Stiles, Lake Orion, MI (US); Thomas A. Spix, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/625,832

(22) Filed: Jan. 23, 2007

(65) Prior Publication Data

US 2008/0173284 A1 Jul. 24, 2008

(51) Int. Cl.
*F02M 25/06* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 3,875,916 A * 4/1975 Patton ..... 123/573
4,011,846 A * 3/1977 Gagliardi ..... 123/568.15
4,090,477 A * 5/1978 Gockel ..... 123/406.11
4,137,878 A * 2/1979 Mineck ..... 123/573
4,515,137 A * 5/1985 Manolis ..... 123/572
4,862,860 A * 9/1989 Shinohara ..... 123/572
6,058,917 A * 5/2000 Knowles ..... 123/573
6,435,170 B1 * 8/2002 Hamelink et al. ..... 123/572

* cited by examiner

*Primary Examiner*—M. McMahon

(57) ABSTRACT

A positive crankcase ventilation system for an internal combustion engine is disclosed. The system includes an engine having a cylinder air intake system connected to associated cylinders and a filtered air inlet to a crankcase for admitting air to mix with crankcase vapors. A throttle is disposed in the cylinder air intake system for controlling airflow to the associated cylinders. The system further includes a venturi nozzle having an inlet and an outlet. The venturi nozzle inlet is connected to the crankcase for receiving the mixture of filtered air and crankcase vapors. The venturi nozzle outlet is connected to the cylinder air intake system at a location subject to variable intake vacuum pressure between the throttle and the cylinders to allow the mixture of filtered air and crankcase vapors to be drawn into the inlet air passing to the cylinders downstream of the throttle.

11 Claims, 2 Drawing Sheets

ENGINE PCV SYSTEM WITH VENTURI NOZZLE FOR FLOW REGULATION

TECHNICAL FIELD

This invention relates to positive crankcase ventilation (PCV) systems, and more particularly to flow regulation in PCV systems.

BACKGROUND OF THE INVENTION

It is known in the art relating to internal combustion engines to use a positive crankcase ventilation (PCV) system to remove crankcase vapors (including unburned fuel and combustion products that leak past the piston rings, oil vapors, and other vapors present in the crankcase) from the crankcase. PCV systems recirculate crankcase vapors in lieu of exhausting the vapors to the atmosphere, thereby reducing engine emissions while also advantageously improving engine efficiency and increasing engine life. Generally, PCV systems utilize engine vacuum to draw fresh air from an engine air intake system through the crankcase. The level of engine vacuum varies with engine operating conditions (i.e., idle, acceleration, constant speed, deceleration). During periods of engine idle or deceleration, engine vacuum is high and therefore capable of producing flow rates through the PCV system that are generally at or above a flow rate necessary for sufficient crankcase ventilation. On the other hand, during periods of constant speed or acceleration, engine vacuum is low and therefore it produces lower flow rates than when the engine vacuum is high. The flow rate through the PCV system is therefore typically regulated to provide desirable flow rates at all or most of the various operating conditions.

Conventionally, there are two common methods in a PCV system of regulating flow from the crankcase to the engine air intake system, such as to the air intake manifold. One method is to use a spring-loaded PCV flow control valve while the other method is to employ a simple orifice in place of a PCV valve. A spring-loaded PCV valve opens at a predetermined pressure differential across the valve (e.g., between the crankcase and the valve outlet). When the pressure differential across the valve is greater than the pressure differential required to open the valve, the flow rate through the valve is approximately constant. While a spring-loaded PCV valve provides a generally constant flow rate above a certain pressure differential, it has a relatively higher cost than a simple orifice and can potentially generate noise at certain points of instability. On the other hand, while a simple orifice design is relatively less complex and less expensive, it provides less than ideal flow regulation for some of the range of pressure differentials present in the PCV system during engine operation. Therefore, a need exists for a PCV system that is both cost effective and able to provide a flow rate through the PCV system that is generally constant over an extended range of the pressure differentials between the crankcase and the engine air intake.

SUMMARY OF THE INVENTION

The present invention provides a PCV system for an internal combustion engine that utilizes a venturi nozzle to regulate flow in place of a spring-loaded PCV valve or a simple orifice. The venturi nozzle is relatively low in cost and simple in design while also capable of maintaining a generally constant flow rate over most of the range of pressure differentials present in the PCV system.

In an exemplary embodiment of the present invention, a positive crankcase ventilation (PCV) system in an engine includes a cylinder air intake system connected to associated cylinders and a filtered air inlet to a crankcase for admitting air to mix with crankcase blow-by gases and other crankcase vapors (all referred to herein as crankcase vapors). A throttle is disposed in the cylinder air intake system for controlling airflow to the associated engine cylinders. The PCV system further includes a venturi nozzle having an inlet and an outlet. The venturi nozzle inlet is connected to the crankcase for receiving the mixture of filtered air and crankcase vapors. The venturi nozzle outlet is connected to the cylinder air intake system at a location subject to variable intake vacuum pressure between the throttle and the cylinders to allow the mixture of filtered air and crankcase vapors to be drawn into the inlet air passing to the cylinders downstream of the throttle.

In a further embodiment, the present invention provides an internal combustion engine including a crankcase and at least one cylinder. A piston is reciprocable in each cylinder and defines a variable volume combustion chamber therein. A filtered cylinder air intake system is in fluid communication with each combustion chamber. A crankcase air inlet is connected between the cylinder air intake system and the crankcase for admitting filtered air into the crankcase to mix with crankcase vapors. A throttle is disposed in the cylinder air intake system downstream of the crankcase air inlet. The engine further includes a venturi nozzle having an inlet and an outlet. The venturi nozzle inlet is connected to the crankcase for receiving the mixture of filtered air and crankcase vapors. The venturi nozzle outlet is connected to the cylinder air intake system between the throttle and the combustion chambers to allow the mixture of filtered air and crankcase vapors to be drawn into the inlet air passing to the combustion chambers by the vacuum developed downstream of the throttle. The venturi nozzle is sized to reach sonic flow velocity during most of the vacuum pressure range of engine operation, thereby controlling PCV vapor flow at a constant value over most of the engine operating range.

These and other features and advantages of the invention will be more fully understood from the following description of certain specific embodiments of the invention taken together with the accompanying drawings.

DESCRIPTION OF AN EXEMPLARY EMBODIMENT

Figure 1:
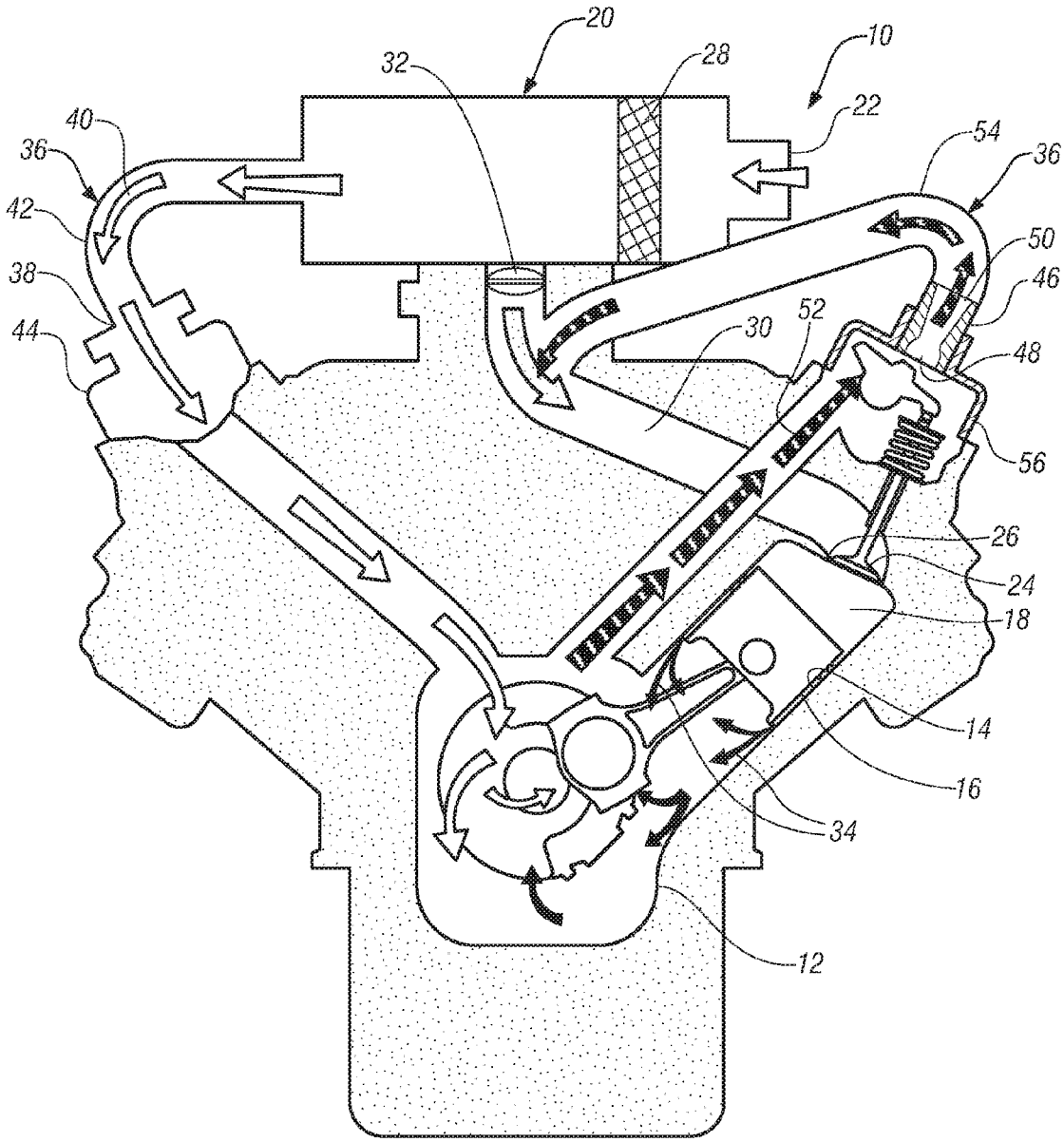
FIG. 1 is a schematic view of an internal combustion engine illustrating a positive crankcase ventilation (PCV) system in accordance with the present invention.

Referring now to the drawings in detail, numeral 10 generally indicates an internal combustion engine in accordance with the present invention. The internal combustion engine 10 generally includes a crankcase 12 and at least one cylinder 14. A piston 16 is reciprocable in each cylinder 14 and defines a variable volume combustion chamber 18 therein. A filtered cylinder air intake system 20 is in fluid communication with each combustion chamber 18. The cylinder air intake system 20 generally extends from the fresh air inlet 22 to the cylinder intake valves 24 located in the cylinder intake ports 26. The cylinder air intake system 20 may include one or more of an air filter 28, a supercharger assembly (not shown), and an air intake manifold 30. A throttle 32 is also disposed in the cylinder air intake system 20 for controlling cylinder intake airflow to the associated cylinders 14. The cylinder air intake system 20 may alternatively be referred to as an air induction system.

During engine operation, fresh inlet air enters the combustion chamber 18 via the cylinder air intake system 20 as the intake valves 24 open and close. The fresh inlet air is mixed with fuel to form a combustible mixture that is ignited to drive the piston 16. In a four cycle engine, during the power stroke in which combustion takes place, some of the combustion products and unburned fuel escape into the crankcase 12 past piston rings of the pistons 16 and adjacent walls of the cylinders 14. The gases that escape past the piston rings are generally referred to as crankcase blow-by gases. The crankcase blow-by gases and other vapors present in the crankcase (for example, oil vapors) are hereinafter collectively referred to as crankcase vapors 34 and are schematically illustrated by black arrows in FIG. 1.

Positive internal ventilation of the crankcase is necessary to extend the useful life of the engine oil and to prevent the escape of controlled air polluting emissions from the engine. To manage the crankcase vapors 34, the engine 10 utilizes a positive crankcase ventilation (PCV) system 36. The PCV system 36 includes a crankcase air inlet 38 connected between the cylinder air intake system 20 and the crankcase 12 upstream of the throttle 32. The crankcase air inlet 38 admits filtered air 40, schematically illustrated by light arrows in FIG. 1, from the cylinder air intake system 20 into the crankcase 12 to mix with crankcase vapors 34 present in the crankcase 12.

The crankcase air inlet 38 may include a conduit 42 such as a tube or hose running from the cylinder air intake system 20 to a fitting on the engine 10, such as a fitting in a valve cover 44 of the engine 10 or other similarly related part such as a cam cover. The PCV system 36 further includes a venturi nozzle 46 having an inlet 48 and an outlet 50. The venturi nozzle inlet 48 is connected to the crankcase 12 for receiving the mixture 52 of filtered ventilation air and crankcase vapors that is schematically illustrated by dashed arrows in FIG. 1. The venturi nozzle outlet 50 is connected to the cylinder air intake system 20 at a location subject to variable intake vacuum pressure between the throttle 32 and the cylinders 14. This allows the mixture of air and crankcase vapors 52 to be drawn into the inlet air in the cylinder air intake system 20 that passes to the cylinders 14. The PCV system 36 thereby ventilates the crankcase and recirculates the crankcase vapors 34 into the combustion chambers 18 to burn the crankcase vapors and to exhaust them through the engine's exhaust system (not shown).

In a specific embodiment, the venturi nozzle outlet 50 may be connected to an air inlet of a supercharger assembly that is connected in the cylinder air intake system 20. Alternatively, as shown in FIG. 1, the venturi nozzle outlet 50 may be connected to the air intake manifold 30 in the cylinder air intake system 20. A conduit 54 such as a tube or hose may connect the nozzle outlet 50 to the intake manifold 30. The venturi nozzle 46 may also be mounted in an engine cover, such as a valve cover 56 of the engine 10, or other similarly related part such as a cam cover, through which flow of the mixture of filtered air and crankcase vapors 52 passes to the vacuum portion of the intake system. Generally, the venturi nozzle 46 may replace a spring-loaded PCV flow control valve, orifice, or other flow regulating device found in a conventional PCV system.

Figure 2:
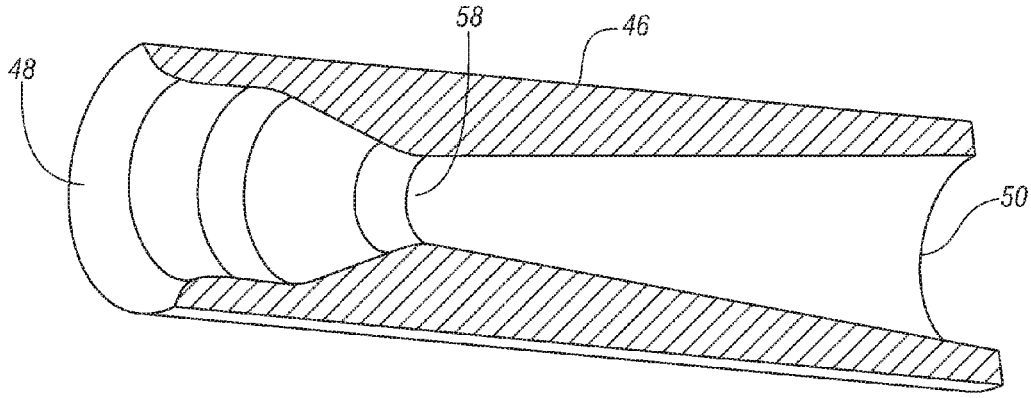
FIG. 2 is a cross-sectional view of a venturi nozzle included in the PCV system of the present invention.

An exemplary venturi nozzle 46 design is illustrated in FIG. 2. The venturi nozzle 46 is sized to provide generally constant flow under engine operating conditions wherein the throttle 32 is at least partially closed and a substantial intake vacuum is present. The venturi nozzle 46 is preferably sized to reach a sonic flow velocity adequate to maintain a vacuum in the crankcase during most normal conditions of engine operation, thereby controlling PCV vapor flow at a constant value over most of the engine operating range.

Figure 3:
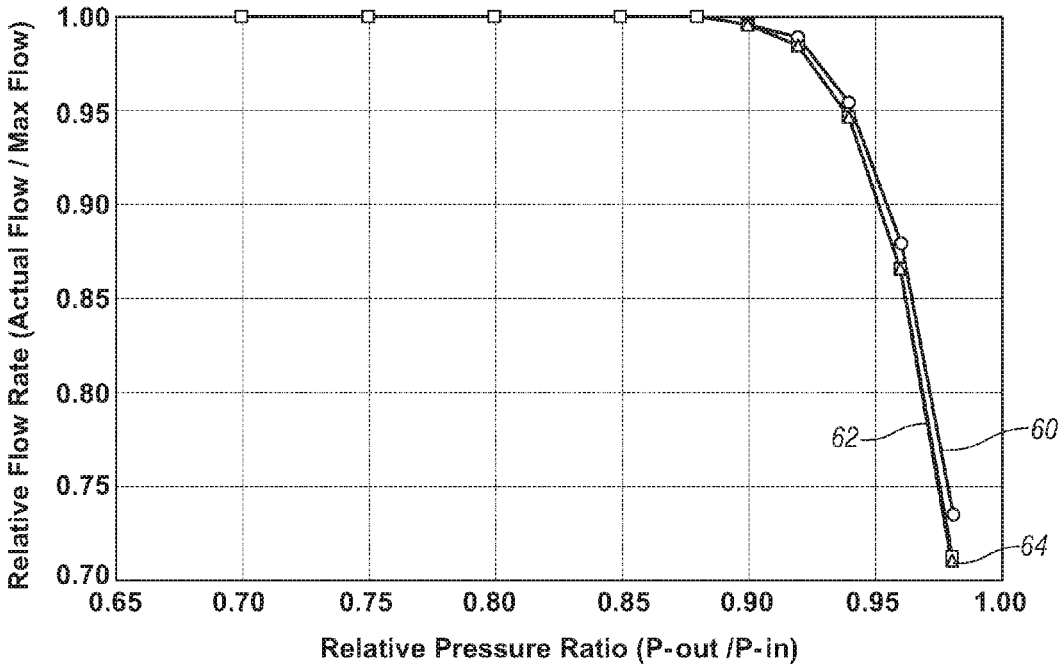
FIG. 3 is a graph of relative flow rate through the venturi nozzle versus relative pressure drop across the venturi nozzle for three sizes of nozzles.

As is graphically illustrated in FIG. 3, with an exemplary venturi nozzle 46, the flow rate through the venturi nozzle (y-axis) is generally constant when the ratio of pressure at the venturi nozzle outlet 50 to pressure at the venturi nozzle inlet 48 (x-axis) is equal to or less than approximately 0.90 wherein the venturi controls the maximum flow. This is a significant improvement over a simple orifice design that begins to limit the flow rate when the pressure ratio is at or below approximately 0.528. The venturi nozzle 46 is therefore capable of passing a much larger maximum flow rate for crankcase ventilation for the same pressure ratio as an orifice with less than two-thirds the maximum flow rate. Further, the maximum flow rate is maintained over most of the engine operating range, dropping off only when the $P_{out}/P_{in}$ pressure ratio drops below 0.90, as may occur during engine operation at or near wide open throttle. It is possible that an ideally configured nozzle could reach an outlet over inlet pressure ratio of up to 0.95 before reaching the maximum flow rate.

The point of minimum diameter of the venturi nozzle 46, also referred to as the throat 46 of the nozzle, determines the maximum stabilized flow rate through the venturi nozzle 46, i.e. the choked flow condition. For example, in a venturi nozzle 46 generally shaped as shown in FIG. 2, a throat radius of approximately 0.9206 mm produces a maximum flow rate of around 30 liters per minute (lpm), a throat radius of approximately 1.1835 mm produces a maximum flow rate of about 50 lpm, and a throat radius of approximately 1.3978 mm produces a maximum flow rate of approximately 70 lpm. Relative flow rates as a function of nozzle pressure drop for the three nozzle sizes described are shown in FIG. 3, the relative flow rate being the actual flow rate through the nozzle relative to maximum flow rate through the nozzle. The nozzle with throat radius of 0.9206 mm is represented by line 60, the nozzle with throat radius of 1.1835 mm is represented by line 62, and the nozzle with throat radius of 1.3978 mm is represented by line 64.

As is apparent from FIG. 3, the relative flow characteristics of the different sizes of nozzles are nearly equivalent. The suitable size and shape for the venturi nozzle 46 therefore depends on such factors as the size of the engine 10 and the flow rate needed to sufficiently vent the engine crankcase 12. The present invention is not limited to any specific size or shape of venturi nozzle.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A positive crankcase ventilation system for an internal combustion engine, the system comprising:

an engine having a cylinder air intake system connected to associated cylinders and a filtered air inlet to a crankcase for admitting air to mix with crankcase vapors;

a throttle disposed in the cylinder air intake system for controlling cylinder intake airflow to the associated cylinders; and a venturi nozzle having a throat spaced between an inlet and an outlet at opposite ends;

the venturi nozzle inlet being connected to the crankcase for receiving the mixture of filtered air and crankcase vapors, and the venturi nozzle outlet being connected to the cylinder air intake system at a location subject to variable intake vacuum pressures between the throttle and the cylinders to allow the mixture of filtered air and crankcase vapors to be drawn into the inlet air passing to the cylinders downstream of the throttle;

wherein the venturi nozzle is sized to provide generally constant sonic velocity flow of the mixture of filtered air and crankcase vapors under engine operating conditions when the throttle is at least partially closed and a substantial intake vacuum is present.

2. The system of claim 1 wherein a flow rate through the venturi nozzle is generally constant when a ratio of pressure at the venturi nozzle outlet to pressure at the venturi nozzle inlet is equal to or less than approximately 0.90.

3. The system of claim 1 wherein the filtered air inlet connects with the cylinder air intake system upstream of the throttle.

4. The system of claim 1 wherein the venturi nozzle outlet is connected to an air inlet of an engine supercharger assembly connected in the cylinder air intake system.

5. The system of claim 1 wherein the venturi nozzle outlet is connected to an engine air intake manifold in the cylinder air intake system.

6. The system of claim 1 wherein the venturi nozzle is mounted in an engine cover through which the flow of the mixture of filtered air and crankcase vapors passes to the vacuum portion of the intake system.

7. An internal combustion engine comprising:

a crankcase and at least one cylinder;

a piston reciprocable in each cylinder and defining a variable volume combustion chamber therein;

a filtered cylinder air intake system in fluid communication with each combustion chamber;

a crankcase air inlet connected between the cylinder air intake system and the crankcase for admitting filtered air into the crankcase to mix with crankcase vapors;

a throttle disposed in the cylinder air intake system downstream of the crankcase air inlet; and a venturi nozzle having a throat spaced between an inlet and an outlet at opposite ends, the venturi nozzle inlet being connected to the crankcase for receiving the mixture of filtered air and crankcase vapors, and the venturi nozzle outlet being connected to the cylinder air intake system at a location subject to variable intake vacuum pressures between the throttle and the combustion chambers to allow the mixture of filtered air and crankcase vapors to be drawn into the inlet air passing to the combustion chambers downstream of the throttle;

wherein the venturi nozzle is sized to provide generally constant sonic velocity flow of the mixture of filtered air and crankcase vapors under engine operating conditions when the throttle is at least partially closed and a substantial intake vacuum is present.

8. The engine of claim 7 wherein a flow rate through the venturi nozzle is generally constant when a ratio of pressure at the venturi nozzle outlet to pressure at the venturi nozzle inlet is equal to or less than approximately 0.90.

9. The engine of claim 7 wherein the cylinder air intake system includes a supercharger assembly, and the venturi nozzle outlet is connected to an air inlet of the supercharger assembly.

10. The engine of claim 7 wherein the cylinder air intake system includes an engine air intake manifold, and the venturi nozzle outlet is connected to the engine air intake manifold.

11. The engine of claim 7 wherein the venturi nozzle is mounted in an engine cover through which the flow of the mixture of filtered air and crankcase vapors passes to the vacuum portion of the intake system.

* * * * *